US009220331B2

(12) United States Patent
Fracassi et al.

(10) Patent No.: US 9,220,331 B2
(45) Date of Patent: Dec. 29, 2015

(54) ARTIFICIAL NAILS INCLUDING APPLICATION TABS

(71) Applicant: Pacific World Corporation, Aliso Viejo, CA (US)

(72) Inventors: Joseph Michael Fracassi, Lake Forest, CA (US); Jeanine Catherine Coppola, Irvine, CA (US)

(73) Assignee: Pacific World Corporation, Lake Forest, CA (US)

( * ) Notice: Subject to any disclaimer, the term of this patent is extended or adjusted under 35 U.S.C. 154(b) by 0 days.

(21) Appl. No.: 14/557,691

(22) Filed: Dec. 2, 2014

(65) Prior Publication Data

US 2015/0096579 A1 Apr. 9, 2015

Related U.S. Application Data

(63) Continuation of application No. 13/056,545, filed as application No. PCT/US2009/052405 on Jul. 31, 2009, now Pat. No. 8,960,200.

(60) Provisional application No. 61/085,723, filed on Aug. 1, 2008.

(51) Int. Cl.
*A45D 29/00* (2006.01)
*A45D 31/00* (2006.01)

(52) U.S. Cl.
CPC ..... *A45D 31/00* (2013.01); *A45D 2029/002* (2013.01); *A45D 2031/005* (2013.01)

(58) Field of Classification Search
CPC ..... A45D 31/00; A45D 29/00; A45D 29/22; A45D 29/001; A45D 29/17; A45D 2031/005; A45D 2029/002
USPC ..... 132/73, 285, 73.5, 319
See application file for complete search history.

(56) References Cited

U.S. PATENT DOCUMENTS

| | | | |
|---|---|---|---|
| 2,239,040 | A | 4/1941 | Holmes |
| D136,030 | S | 7/1943 | Belmonte et al. |
| 2,417,677 | A | 3/1947 | Cohan |
| 2,941,535 | A | 6/1960 | Lappe |
| 3,157,912 | A | 11/1964 | Lisczawka |
| 3,552,401 | A | 1/1971 | Michaelson et al. |
| 3,578,158 | A | 5/1971 | Aylott |

(Continued)

FOREIGN PATENT DOCUMENTS

| | | | |
|---|---|---|---|
| EP | 0167329 | A2 | 1/1986 |
| EP | 1415567 | A1 | 5/2004 |

(Continued)

OTHER PUBLICATIONS

Broadway Nails, "Fast French Nail Kit," Retail product packaging purchased on Mar. 26, 2009.

*Primary Examiner* — Robyn Doan
(74) *Attorney, Agent, or Firm* — McGuireWoods LLP

(57) ABSTRACT

A kit including a package containing a plurality of preformed artificial nails having an application tab that removably clings to a surface of the nail, the application tab assembly including a body protruding from the nail, an attachment portion, and, optionally, an adhesive disposed between the body and the artificial nail. The clinging portion of the attachment portion, and the adhesive, if utilized, leaves substantially no residue on the artificial nail when the application tab assembly is removed from the surface of the artificial nail.

30 Claims, 3 Drawing Sheets

(56) References Cited

U.S. PATENT DOCUMENTS

| | | | | |
|---|---|---|---|---|
| 3,584,908 | A | 6/1971 | Ray | |
| 3,722,104 | A | 3/1973 | Enzetti | |
| 3,935,872 | A | 2/1976 | Aylott | |
| 3,982,551 | A | 9/1976 | Bartolucci | |
| 3,993,084 | A | 11/1976 | Cullen | |
| 4,007,748 | A | 2/1977 | Matranga et al. | |
| 4,106,614 | A | 8/1978 | Aylott | |
| 4,346,720 | A | 8/1982 | Hokama | |
| 4,479,672 | A | 10/1984 | Jermyn | |
| 4,554,935 | A | 11/1985 | Hokama | |
| D285,367 | S | 8/1986 | Lindner | |
| 4,625,740 | A | 12/1986 | Roth | |
| 4,648,416 | A | 3/1987 | Kilman et al. | |
| 4,718,957 | A | 1/1988 | Sensenbrenner | |
| 4,751,935 | A | 6/1988 | Mast et al. | |
| 4,765,350 | A | 8/1988 | Moore | |
| 4,805,645 | A | 2/1989 | Schiff et al. | |
| 4,834,654 | A | 5/1989 | Nussbaum | |
| D309,196 | S | 7/1990 | LaJoie | |
| 4,947,876 | A | 8/1990 | Larsen | |
| 4,953,902 | A | 9/1990 | Brown | |
| 5,005,595 | A | 4/1991 | Aylott | |
| 5,060,678 | A | 10/1991 | Bauman et al. | |
| 5,070,892 | A | 12/1991 | Trematerra | |
| 5,209,250 | A | 5/1993 | Taeckens | |
| 5,450,864 | A | 9/1995 | LaJoie et al. | |
| 5,513,664 | A | 5/1996 | Krupsky | |
| D376,224 | S | 12/1996 | Fojon | |
| 5,676,165 | A | 10/1997 | Bannett | |
| D386,823 | S | 11/1997 | Carroll et al. | |
| 5,699,813 | A | 12/1997 | Carroll | |
| 5,791,482 | A | 8/1998 | Murphy et al. | |
| 5,816,408 | A | 10/1998 | Indelicato | |
| 5,832,936 | A | 11/1998 | Pruchnic et al. | |
| 5,860,429 | A | 1/1999 | Chang | |
| 5,901,714 | A | 5/1999 | Benkart | |
| 5,904,149 | A | 5/1999 | Ruhl et al. | |
| 5,908,035 | A | 6/1999 | Carroll et al. | |
| 5,913,556 | A | 6/1999 | Perusse | |
| 5,944,027 | A | 8/1999 | Chang | |
| D433,536 | S | 11/2000 | Schwartz | |
| 6,196,234 | B1 | 3/2001 | Gifford | |
| D441,134 | S | 4/2001 | Manzione | |
| 6,220,250 | B1 | 4/2001 | Park | |
| 6,328,039 | B1 | 12/2001 | Chang | |
| 6,354,304 | B1 | 3/2002 | Chang | |
| D455,866 | S | 4/2002 | Baltierra | |
| 6,892,736 | B2 | 5/2005 | Chang et al. | |
| D525,747 | S | 7/2006 | Robinson | |
| 7,100,619 | B2 | 9/2006 | Kim | |
| 7,150,281 | B2 | 12/2006 | Han | |
| 7,185,660 | B1 | 3/2007 | Han | |
| 7,337,783 | B2 | 3/2008 | Han | |
| 7,389,876 | B2 | 6/2008 | Hong et al. | |
| 7,677,257 | B2 | 3/2010 | Han | |
| 7,997,283 | B2 * | 8/2011 | Fracassi et al. | 132/73 |
| 8,132,568 | B2 * | 3/2012 | Fracassi et al. | 132/73 |
| 8,240,731 | B2 | 8/2012 | Roszak | |
| 8,960,200 | B2 * | 2/2015 | Coppola et al. | 132/73 |
| 2002/0002980 | A1 | 1/2002 | Chang et al. | |
| 2002/0023656 | A1 | 2/2002 | Chang | |
| 2002/0185144 | A1 | 12/2002 | Chang et al. | |
| 2003/0178040 | A1 | 9/2003 | Swensen | |
| 2003/0209250 | A1 | 11/2003 | Chang | |
| 2004/0079381 | A1 | 4/2004 | Han | |
| 2004/0112397 | A1 | 6/2004 | Riester | |
| 2004/0173232 | A1 | 9/2004 | Chang et al. | |
| 2004/0216757 | A1 | 11/2004 | Chang | |
| 2005/0121048 | A1 | 6/2005 | Han | |
| 2005/0150814 | A1 | 7/2005 | Tallon | |
| 2005/0183735 | A1 | 8/2005 | Robinson | |
| 2005/0217686 | A1 | 10/2005 | Lee | |
| 2005/0268931 | A1 | 12/2005 | Chang | |
| 2006/0191551 | A1 | 8/2006 | Han | |
| 2006/0237027 | A1 | 10/2006 | Han | |
| 2007/0051384 | A1 | 3/2007 | Fracassi et al. | |
| 2007/0107745 | A1 | 5/2007 | Kiyomoto | |
| 2007/0224288 | A1 | 9/2007 | Kim | |
| 2007/0277841 | A1 | 12/2007 | Kim | |
| 2008/0017211 | A1 | 1/2008 | Han | |
| 2008/0017212 | A1 | 1/2008 | Han | |
| 2008/0017213 | A1 | 1/2008 | Han | |
| 2008/0017214 | A1 | 1/2008 | Han | |
| 2008/0099037 | A1 | 5/2008 | Chang | |
| 2008/0251092 | A1 | 10/2008 | Han | |
| 2008/0283073 | A1 | 11/2008 | Park | |
| 2008/0283076 | A1 | 11/2008 | Fracassi et al. | |
| 2011/0030711 | A1 | 2/2011 | Han | |

FOREIGN PATENT DOCUMENTS

| | | | |
|---|---|---|---|
| EP | 1902644 | A2 | 3/2008 |
| EP | 1902645 | A1 | 3/2008 |
| EP | 1920675 | A1 | 5/2008 |
| FR | 1549317 | A | 12/1968 |
| FR | 2534120 | A1 | 10/1982 |
| GB | 752960 | | 7/1954 |
| GB | 725969 | | 3/1955 |
| JP | 2002-034641 | A | 2/2002 |
| JP | 2004-081843 | A | 3/2004 |
| JP | 2006-181349 | A | 7/2006 |
| KR | 2002-0008283 | A | 1/2002 |
| KR | 20-0327518-000 | Y | 9/2003 |
| KR | 2004-0059956 | A | 7/2004 |
| KR | 2005-0079081 | A | 8/2005 |
| KR | 10-0605671 | B1 | 8/2006 |
| KR | 10-0659692 | B1 | 12/2006 |
| KR | 10-0737424 | B1 | 7/2007 |
| KR | 10-0765332 | B1 | 10/2007 |
| KR | 20-0438231 | Y1 | 2/2008 |
| WO | WO 02/00057 | A2 | 1/2002 |
| WO | WO 2006/062963 | A1 | 6/2006 |
| WO | WO 2008/111759 | A1 | 9/2008 |

* cited by examiner 22
54
35
36
50
60
3
52
33

37
58

ARTIFICIAL NAILS INCLUDING APPLICATION TABS

RELATED APPLICATIONS

This application is a continuation application of U.S. application Ser. No. 13/056,545, filed Apr. 29, 2011, which is a Nation Stage entry under 35 U.S.C. §371 of PCT/US2009/052405, filed Jul. 31, 2009, which claims the priority benefit of U.S. Provisional Patent Application Ser. No. 61/085,723, filed Aug. 1, 2008. The entire contents of each of the above-mentioned applications are hereby incorporated by reference.

FIELD OF THE INVENTION

The present invention relates to human nail decorations, and more specifically the invention pertains to structure and methods for placement of preformed artificial nails and tips for adherence to human nails.

BACKGROUND OF THE INVENTION

For various aesthetic reasons, many individuals wish to possess elongated fingernails or fingernails having a more finished or polished appearance. However, some are unable or unwilling to grow their own natural fingernails out to the desired length. Alternately, they may not have the time, skill, or financial wherewithal to maintain or obtain a more finished appearance that may result from well-manicured and/or polished nails. As a result, entire industries have developed around the artificial supplementation and enhancement of natural nails. Such enhancements may range from manicuring and polishing of natural fingernails to individually building artificial nails on the natural nail and nail form from an acrylic powder and liquid, which chemically bond to the nail surface as the artificial nail is built. Between these two extremes, are preformed, artificial nails that are glued or otherwise bonded to a person's own naturally occurring fingernails. Such nails are readily available to a wide range of users through drug and department stores. Such preformed artificial nails may be clear or opaque, and/or prepolished and/or decorated to provide the desired appearance.

Artificial nails are commonly made from molded thermoplastic and are available in a wide range of lengths and styles. One broad category of an artificial nail style is the full nail form. As its name implies, the full nail form simulates the entire human fingernail and includes a proximate edge intended to overlay substantially the entire nail bed and a distal free edge, which is intended to extend beyond the fingertip of the wearer. The proximate edge is shaped to be disposed substantially adjacent or abut against the cuticle of the finger. The distal free edge may have any of various lengths and shapes, such as oval, square, or flared, depending upon the desired look. Preferably, the artificial nail is sufficiently durable and rigid to withstand the hazards inherent in its use.

In contrast, nail tips do not simulate the complete nail, but, rather, only the free edge and, typically, a small extended portion to cover only a portion of the nail bed in order to facilitate attachment to the nail. In use, nail tips are secured to the edge of the nail bed adjacent the free edge and the tip only. Tips are often utilized with the construction of acrylic nails or gel nails.

Manufacturers typically provide users with a range of nail sizes, e.g., identified by size numbers 0-9, to accommodate most nail sizes. Generally, artificial nails are packaged together in sets including a range of different sizes so that the purchaser receives differently artificial nails for their different fingers. In addition to the set of different sized artificial nails, the package may also include liquid adhesive, peel-off adhesive pads, and/or preplaced tacky adhesive for bonding the artificial nails to the purchaser's natural fingernails.

Artificial nails are provided in a variety of lengths ranging from relatively long nails having either a straight profile or arched profile, to relatively short nails, which more closely simulate well-groomed natural nails. In placement of the artificial nail on a user's natural nail, the adhesive is typically applied either directly to the user's natural nail bed or to the nail bed portion of the artificial nail. The artificial nail is then placed on the user's natural nail bed with the proximal end of the artificial nail disposed at or near the user's cuticle, and pressure is applied to ensure the desired adhesion of the artificial nail to the user's natural nail. Inasmuch as the adhesive used in placing artificial nails is generally tacky, it is difficult adjust the position of the artificial nail on the natural nail once initial placement is made. Attempts to reposition the artificial nail relative to the natural nail or to remove and replace the artificial nail may result in either a substandard appearance to the artificial nail, or time consuming additional cleaning of the artificial nail and repetition of the placement process. As a result, it is important that the artificial nail be placed at the desired position on the natural nail at the first attempt so as to avoid the need to remove and reposition the nail.

Longer artificial nails typically extend well beyond the free edge of the user's natural nails. Consequently, in placing relatively long artificial nails on the user's natural nails, one may generally utilize the extended free edge of the artificial nail to hold the artificial nail prior to placement, and to manipulate and accurately position the artificial nail on the user's nail bed. When utilizing smaller artificial nails, however, the free edge is very short, and does not extend far beyond the user's natural nail or fingertip, if at all. Accordingly, such short nails can be particularly difficult to accurately place on the user's natural nail by simply grasping the artificial nail using one's fingers.

As a result, manufacturers have proposed various tools to allow for holding and placing artificial nails during application. One such tool is comprises an elongated rod with a tacky adhesive pad or tape at the end of the tool to grip the artificial nail, such as the tools shown in U.S. Pat. No. 6,220,250 to Park and the tool marketed by Sally Hansen®. This tacky, adhesive pad, however, has proven unreliable in use, however, inasmuch as the retaining force exerted by the adhesive on the artificial nail typically deteriorates over time such that it does not exert a consistent retaining force on the artificial nail. Moreover, should the adhesive pad become contaminated with dust or the like, it becomes generally useless in that it does not exhibit adequate force to retain a series of nails for placement.

Another such tool is shaped like a concave shovel with a shorter opposing lip that is disposed parallel to the shovel such that a small slot or gap is formed between the inside surface of the shovel and the lip, as shown in U.S. Pat. D441,134 to Manzione and marketed by Uptown Nails, LLC. In use, the outer, arched surface of the artificial nail is disposed against the inside surface of the shovel with the free edge of the artificial nail disposed in the gap between the lip and the shovel. This tool likewise exhibits deficiencies. While the "shovel" tool does not deteriorate with use, it is cumbersome to utilize. Should the gap between the shovel and lip be sufficiently small to exert a retaining force on the artificial nail, the user will typically be required to exert an external downward, retaining force on the artificial nail when it is placed against the natural nail in order to facilitate release of the artificial nail by the tool. Inasmuch as the user's free hand grasps the tool, the user must typically use a different finger from the placement hand to exert a retaining force the placed artificial nail to facilitate release of artificial nail from the tool. Conversely, if the tool does not exert adequate retaining force to hold the artificial nail during the placement process, the tool may allow artificial nail to move within the gap, making accurate placement of the artificial nail against the natural nail significantly more difficult.

The assignee of the present invention has proposed a tool that utilizes a small suction cup disposed at the distal end of an elongated rod. In applying an artificial nail to a natural nail, the user places the suction cup on the upper surface of the artificial nail and expels any air trapped between the cup and the nail. The user then utilizes the tool to position the artificial nail on the natural nail. The suction cup provides sufficient force to retain the nail during placement, yet that force is overcome by the tackiness of the adhesive or the adhesive bond between the artificial nail and the natural nail once properly placed. The tool is disclosed in greater detail in PCT Publication WO06/062963A.

Manufacturers have likewise proposed severable protrusions that extend from one or more edges of the artificial nail themselves. The protrusions are utilized to place the artificial nail and then severed from the nail once proper placement has been achieved. For example, U.S. Pat. No. 6,892,736 to Chinn et al. includes a tab that extends from the distal edge of the nail. Unfortunately, however, the Chinn tab is not ergonomic, and is difficult and cumbersome to use. As may be seen in FIG. 11 of the Chinn patent, the Chinn tab 13 must typically be held between a finger 14 and the thumb 15 of the applying hand 16, the thumb 15 being disposed either below or above the plane of the artificial nail 17. Accordingly, the user's hand 16 is in an awkward position relative to the receiving finger. As a result, typically, either a separate finger from the receiving hand must be used to securely seat the artificial nail 17 in position on the natural nail during severing of the nail tab 13, or the user must hold the artificial nail 17 in position until such time as the adhesive fully cures. Similar difficulties are encountered in placing the nails disclosed in other references, such as U.S. Pat. No. 5,005,595 to Aylott, for example.

The assignee of the present application has proposed a more ergonomic application tab arrangement wherein the body of the tab is disposed at an angle to the plane containing the nail. In this way, the user may readily grasp the body of the tab with the middle finger and the thumb of the applying hand to place the attached nail on the user's natural fingernail of the receiving hand, while the user's index finger of the applying hand presses the artificial nail to the natural nail. This arrangement is disclosed in greater detail in U.S. application Ser. No. 11/739,371 filed Apr. 24, 2007.

While application tabs to date may be useful in placement of a relatively short nail, all such commercial tabs have been molded with the artificial nail, and, therefore, must be severed from the artificial nail following placement, by snapping or cutting the tab from the artificial nail, for example. An acceptable appearance may require the user to perform subsequent manicuring work to file any burr that may remain on the nail at the location where the tab has been severed.

As a result, it is desirable to provide a nail placement arrangement that overcomes these shortcomings of the prior art to provide for accurate and reliable, repeatable placement of artificial nails while minimizing or eliminating any subsequent manicuring work in order to provide an acceptable and appealing appearance.

BRIEF SUMMARY OF THE INVENTION

The invention provides a nail application tab that includes an attachment portion that is disposed along a surface of the artificial nail and an extension portion that extends generally from the distal end of the nail. The attachment portion of the application tab includes an adhesive or be of a clingy structure that temporarily adheres to the nail, but preferably leaves no residue when the tab is removed from the artificial nail. While the extension portion of the application tab is typically disposed at a plane that is substantially contiguous with or parallel to the plane of the artificial nail, the extension portion may alternately be disposed at an angle to a plane containing the top surface of the artificial nail when taken along the centerline. An embodiment of the application tab may include a flange portion that is disposed adjacent an edge of the artificial nail. Such a flange portion may assist in maintaining the extension portion of the application tab in a relative rigid position relative to the artificial nail during application of the same to a natural nail. The application tab may be formed of a relatively flexible material or of a relatively rigid plastic or the like, or a combination thereof. The application tab may extend from one or more of any of the distal edge, or top or bottom surface of the nail. After placement, the application tab is lifted from the artificial nail, the adhesive continuing to adhere to the tab, rather than the nail, in embodiments of the tab including an adhesive. Thus, following removal of the application tab from the artificial nail, no subsequent manicure work is required to provide an acceptable appearance.

The artificial nail with adhesive tab may be provided as part of a plurality of such nails in a kit. The kit may further include additional items and tools, such as an adhesive, a towelette including a cleaner, a roughening surface, a stick, such as a rosewood stick, and/or a placement tool for future reapplication of the artificial nails.

These and other objects and advantages of the invention will be apparent to those skilled in the art upon reading the following summary and detailed description and upon reference to the drawings.

DETAILED DESCRIPTION

Figure 1:
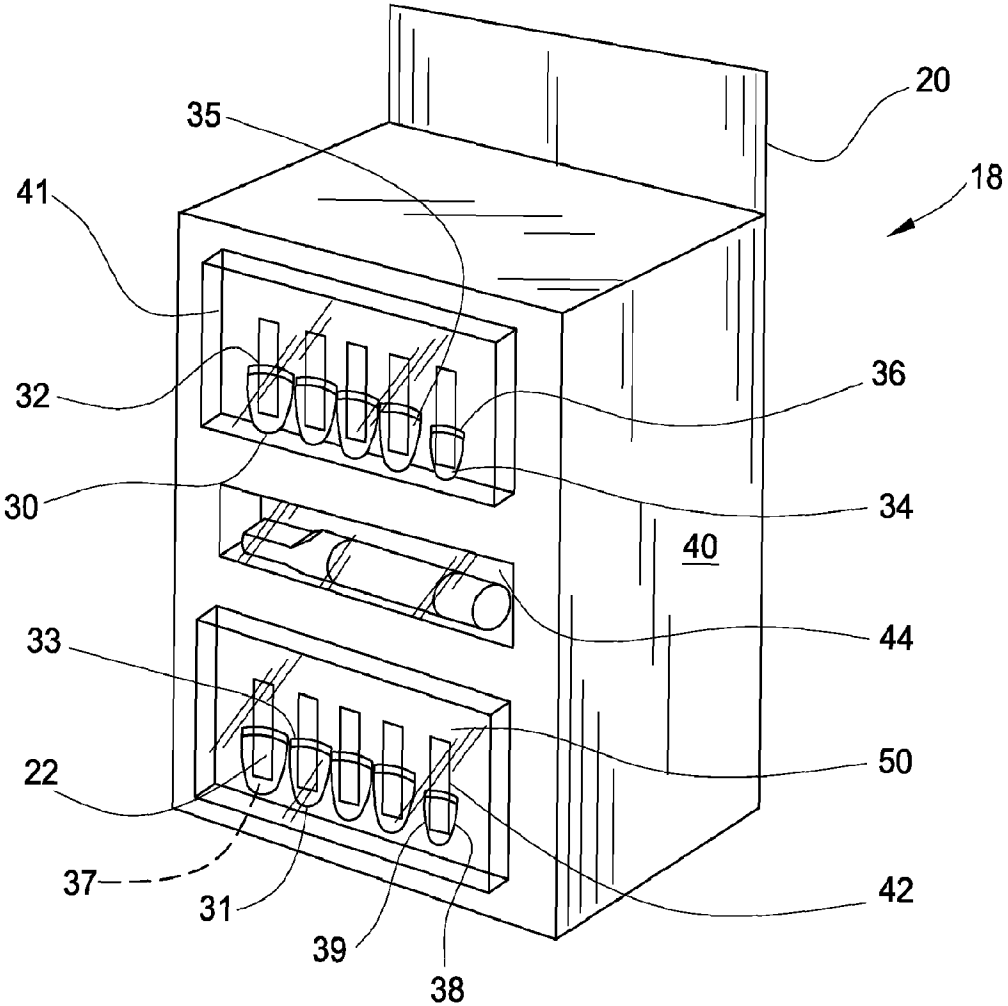
FIG. 1 is a perspective view of a kit having exemplary contents, including an artificial nail according to teachings of the invention.

Turning now to the drawings, wherein like reference numbers refer to like elements, there is illustrated in FIG. 1 a nail kit 18 comprising a package 20 containing a plurality of preformed artificial nail assemblies. Each nail assembly comprises an artificial nail 22 which has a proximal end 30. In a full nail arrangement illustrated, the proximal end 30 is adapted to be placed generally adjacent the user's cuticle, while in a nail tip arrangement, the proximal end 30 is adapted to be spaced from the user's cuticle. Each nail assembly 22 further includes a distal end 32 that is generally disposed at or beyond the end of the user's natural nail when properly placed. The areas between the proximal and distal ends 30, 32 of the artificial nail 22 generally define the nail bed portion 34 and the free end 36, the nail bed portion 34 being adapted to be placed adjacent the user's natural nail bed and the free end portion 36 being adapted to extend beyond the end of the user's finger. The artificial nail 22 includes an upper surface 35, and the free end portion 34 includes a lower surface 37. The artificial nails 22 further include right and left side edges 38, 39 with the nail 22 having a generally arched contour between the side edges 38, 39 and a generally less arched contour between the proximal and distal edges 31, 33.

It will be appreciated by those of skill in the art that the proximal edge 31 of a full artificial nail is ultimately intended to be placed substantially adjacent or proximal to the cuticle of the user's natural nail, with the nail bed portion 34 covering substantially the entire surface of the user's natural nail bed. While artificial nail tips include similar structure, the proximal edge of a nail tip is not intended to be placed adjacent the cuticle of the user's natural nail. Rather, the proximal edge of a nail tip is spaced away from the user's cuticle. The nail bed portion of the tip is intended to be placed generally along the distal end of the natural nail, covering at least a portion of the free edge of the user's natural nail, and possibly a portion of the nail bed portion of the user's natural nail. For the purposes of this disclosure and the claims appended hereto, the term artificial nail will be used to refer generally to both full artificial nails and artificial nail tips.

The nail kit package 20 typically includes an outer covering 40, here in the form of a box, having at least one transparent portion 41 for viewing the contents of the package 20. The package 20 further includes an inner support housing 42 that generally retains the contents of the package 20 in position within the package 20. The inner support housing is typically formed of a polymeric material. The inner support housing 42 generally includes a plurality of recessed areas 44, and additional contents of the package 20 may be retained in a rear open portion of the inner support housing 42. The nail kit 18 may be of an alternate design. Similarly, the package 20, outer covering 40, transparent portion 41, support housing 42 and recessed areas 44 may be of an alternate design or be excluded altogether.

In accordance with the disclosure, the artificial nail assembly includes an application tab assembly 50 to facilitate placement of the artificial nail 22 on a natural nail. The tab assembly 50 includes a body 52 for the user to grasp during placement, and an attachment portion 54 that extends between the body 52 and the nail 22. According to a feature of the invention, at least a portion of the attachment portion 54 includes clings to a portion of the artificial nail. The clingy portion may include an adhesive 56 disposed between the attachment portion 54 and the artificial nail 22. Alternately, the material of the tab assembly 50 itself may be sufficiently clingy to temporarily adhere to a surface of the artificial nail 22 without adhesive. When utilized, the adhesive 56 may be of any suitable composition that provides for temporary, rather than permanent disposition of the attachment portion 54 of the tab assembly 50 along a surface of the artificial nail 22. Thus, in use, at least a portion of the attachment portion 54 is disposed along the upper surface 35 of the nail 22 or the lower surface 37 of the nail 22. It will be appreciated, however, that the tab assembly 50 may be more cumbersome to remove if it is disposed along the lower surface 37 unless the user's natural nail is shorter than the artificial nail 22.

Although any suitable adhesive 56 may be utilized, in an embodiment, "Skin Contact Adhesives," or adhesives that are suitable for skin contact applications such that they will not permanently adhere to the surface of the artificial nail 22 may be suitable for use in adhering the tab assembly 50 to an artificial nail 22. Such adhesives are often utilized for bandages, temporary tattoos, or the like, and typically provide optimal clarity, as well as superior water and humidity resistance. An example of such an adhesive is SC-38A by Multi-Tac Inc., which typically includes on the order of 52% solids, a viscosity of 850 CP, a pH of 7.0, and an MVTR of 1522 $g/m^2/24$ hours.

The adhesive 56, if utilized, may be applied in any appropriate thickness, so long as adequate adherence is provided based upon the area covered and no residue remains on the nail 22 itself after the tab assembly 50 is removed. In an embodiment, a typical coating may have a coating thickness, for example, of 1 mil. For example, a one mil coating of SC-38A on a low density polyester (LDPE) of a two mil thickness may have a tackiness of 10 oz/in, and may require 20 oz/in at a 180° peel after 20 minutes, and 21 oz/in at a 180° peel after 24 hours. After three hours, such an arrangement may exhibit a shear strength of 4.4 psi at 72° F.

The tab assembly 50 may be formed of any appropriate material, and by any appropriate method. The tab assembly 50 may be a film-like structure, such as is illustrated in FIGS. 1-4, or a molded structure, such as is illustrated in FIGS. 5-8. The tab is typically formed of polymeric materials, such as, by way of example only, acrylonitrile butadienestyrene (ABS), polyethylene, polypropylene, vinyl, silicone, and polyester, although alternate materials may be utilized. In an embodiment, at least the attachment portion 54 of the tab assembly 50 is substantially transparent or translucent so that the user may view readily view the placement of the artificial nail 22 on the natural nail before applying pressure to the artificial nail 22 on the natural nail face.

The tab assembly 50 may be molded of a single material, as shown in FIGS. 1-4, or it may include more than one material. For example, the attachment portion 54 may be formed of a flexible material, while the body 52 may be formed of a more rigid material. For example, the attachment portion 54 may be formed of silicone, while the body portion 52 is formed of a more rigid plastic. This arrangement is particularly suitable for the embodiment illustrated in FIGS. 5-8. The tab may be fabricated by any appropriate method, such as, by way of example only, cut or stamped from a preformed sheet, molded, or co-molded from more than one material.

It will be appreciated that, depending upon the material utilized and/or the structure of the tab assembly 50, the tab assembly 50 may not require adhesive to cling to the surface of the artificial nail 22. For example, a tab assembly 50 that is formed of a silicone material, another material having a tacky surface, whether or not by way of additives, or the like, may temporarily cling to the surface of the artificial nail 22 adequately to allow the user to properly place the artificial nail 22 before removing the tab assembly 50.

The tab assembly 50 may be of any appropriate size and shape relative to the artificial nail 22. More specifically, the attachment portion 54 may be of any appropriate size and shape, so long as the combination of the area of the attachment portion 54 and the adhesive 56 are adequate to provide a secure assembly with the artificial nail 22 until the nail 22 is appropriately placed during use. By way of example only, the attachment portion 54 may have the generally rectangular structure illustrated in FIGS. 2-4, or the oval structure illustrated in FIGS. 4-7, or any other appropriate shape and structure.

Similarly, the body 52 may be of any appropriate shape and disposition, so long as it is of an adequate size for the user to grasp during placement. Although the tab assembly 50 is illustrated as a thin, film-like structure, the tab need not be thinly formed, but, rather, a thicker structure. By way of example only, the body 52 may have the relatively flat, elongated shape illustrated in FIGS. 2-4 or the oval structure illustrated in the embodiment of FIGS. 5-8.

Figure 2:
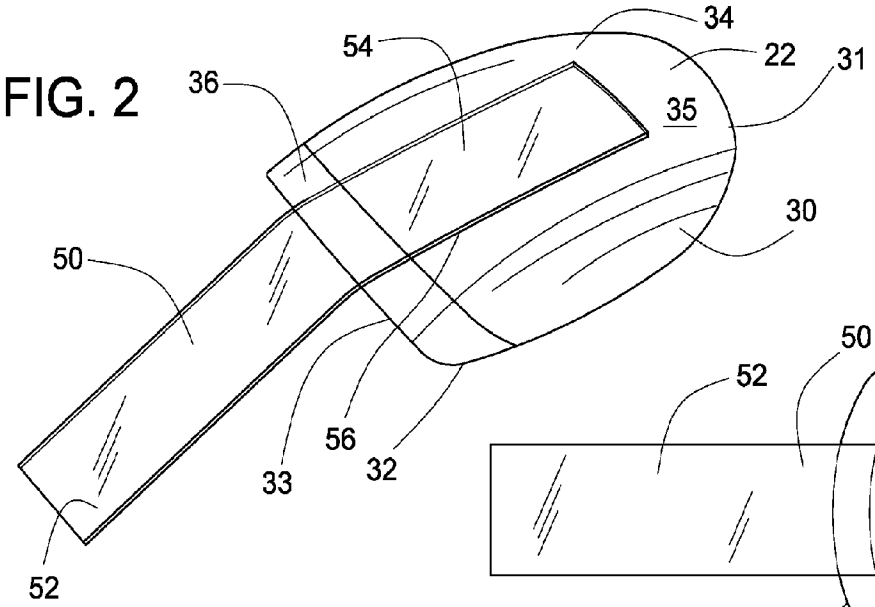
FIG. 2 is a perspective view of an artificial nail with application tab constructed in accordance with teachings of the invention.
Figure 3:
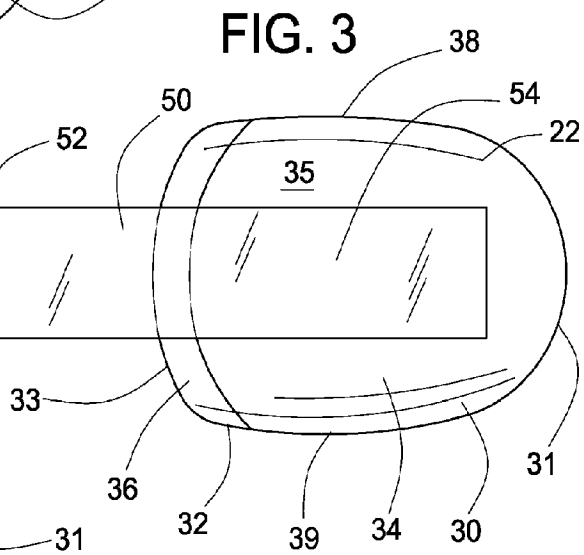
FIG. 3 is top plan view of the artificial nail of FIG. 2.
Figure 4:
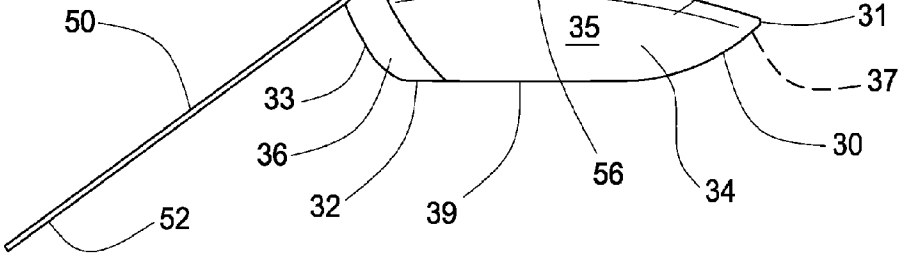
FIG. 4 is a side elevational view of the artificial nail of FIGS. 2 and 3.
Figures 5, 6, 7, 8:
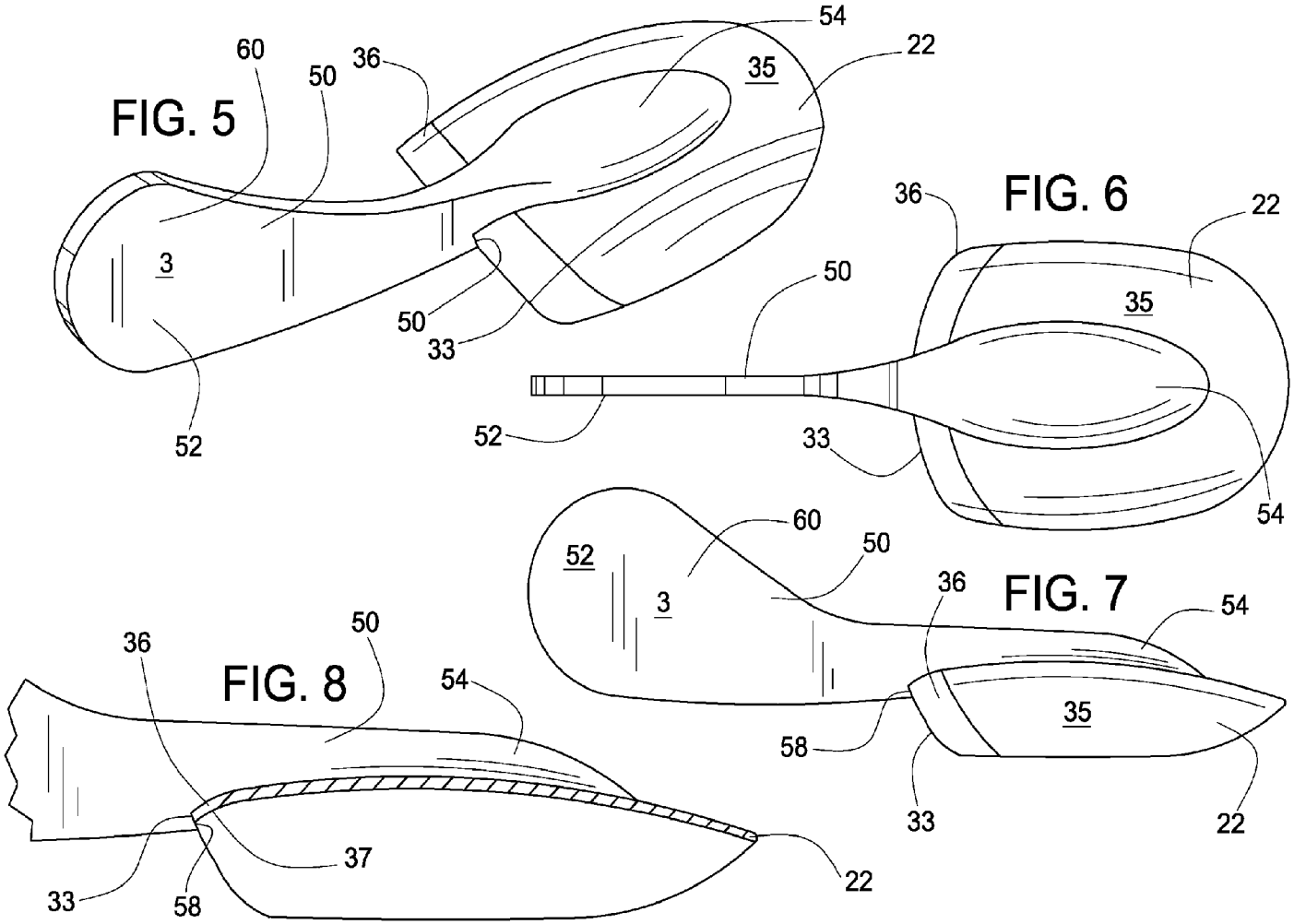
FIG. 5 is a perspective view of an alternate embodiment of an artificial nail with application tab constructed in accordance with teachings of the invention.
FIG. 6 is a top plan view of the artificial nail of FIG. 5.
FIG. 7 is a side view of the artificial nail of FIGS. 5 and 6.
FIG. 8 is a cross-sectional view of the artificial nail of FIGS. 5-7.

The body 52 may likewise be disposed at any appropriate angle to the surface of the nail 22. By way of example only, the body 52 may be in relatively the same plane as the nail 22, as shown in FIGS. 2-4, or it may be disposed at an angle to a plane including the upper surface of the nail, as shown in FIGS. 5-8.

According to an embodiment, the tab assembly 50 may further include a flange 58 or the like that engages the edge 33 of the nail 22, as shown in the embodiment of FIGS. 5-8, or the bottom surface 37 of the free end portion 36. It will be appreciated that the flange 58 may provide added stability to the tab assembly 50 during placement of the artificial nail 22 on the user's natural nail.

The application tab assembly 50 may additionally include indicia 60 as desired. By way of example only, the indicia 50 may include an identification of a company, or of a size of the associated artificial nail 22.

In use, the user applies adhesive to either the natural nail or to the lower surface of the artificial nail 22. If preglued nails are utilized, no adhesive application is necessary, although, if appropriate, the user would remove any tack resistant paper along the preglued portion. The user then grasps the body 52 of the tab assembly 50 and utilizes the body 52 to place the artificial nail 22 on the user's natural nail. A downward pressure may be applied the upper surface 35 of the artificial nail 22 to ensure that it is securely seated on the natural nail. The user then uses a pealing or other appropriate motion to lift the body 52 to remove the tab assembly 50 from the positioned artificial nail. It will be appreciated by those of skill in the art that such an arrangement facilitates easy and accurate placement of the artificial nail 22, while requiring no subsequent manicuring.

While this invention has been described with an emphasis upon preferred embodiments, variations of the preferred embodiments can be used, and it is intended that the invention can be practiced otherwise than as specifically described herein. Accordingly, this invention includes all modifications encompassed within the spirit and scope of the invention as defined by the following claims.

All of the references cited herein, including patents, patent applications, and publications, are hereby incorporated in their entireties by reference.

We claim as our invention:

1. A kit of preformed artificial nails, the kit comprising:

(1) a plurality of preformed artificial nail assemblies for placement on a natural nail by a user, each said artificial nail assembly comprising:

(a) an artificial nail sized to correspond to at least a portion of said natural nail, said artificial nail including an upper surface and a lower surface, and (b) a one-piece application tab assembly temporarily adhered to the upper surface of said artificial nail, said application tab assembly comprising:

(i) an attachment portion, wherein at least a portion of said attachment portion comprises a clingy portion having sufficient tackiness to temporarily adhere to said upper surface, (ii) a body portion, wherein at least a portion of said body portion protrudes from said upper surface and is of sufficient size to be grasped by a user to manipulate said application tab assembly and related artificial nail, and (iii) a flange portion; and (2) a package containing said plurality of preformed artificial nail assemblies.

2. The kit of claim 1 wherein said flange is disposed adjacent an edge of said artificial nail.

3. The kit of claim 1 wherein said flange engages the lower surface of said artificial nail.

4. The kit of claim 1 wherein said flange provides added stability to said assembly during placement of said artificial nail on a user's natural nail.

5. The kit of claim 1, wherein the body portion of said application tab is disposed at an angle to a plane including the upper surface of said artificial nail.

6. The kit of claim 1, wherein said body portion is disposed in relatively the same plane as the upper surface of said artificial nail.

7. The kit of claim 1, wherein said attachment portion is disposed in relatively the same plane as the upper surface of said artificial nail.

8. The kit of claim 1 further comprising at least one artificial nail having no application tab assembly adhered thereto.

9. The kit of claim 1, wherein said clingy portion further comprises an adhesive disposed between said attachment portion and the upper surface of said artificial nail, said adhesive being adapted to removably adhere to the upper surface of said artificial nail.

10. The kit of claim 9 wherein said adhesive leaves substantially no residue on said upper surface when said application tab assembly is removed from said artificial nail.

11. The kit of claim 1 wherein the application tab assembly includes indicia.

12. The kit of claim 1 wherein at least a portion of the application tab assembly is substantially transparent or translucent.

13. The kit of claim 1 wherein the application tab assembly comprises a film strip.

14. The kit of claim 1 wherein the application tab assembly is molded prior to attachment to the upper surface of the artificial nail.

15. The kit of claim 1 wherein at least a portion of the application tab assembly is formed of a polymeric material.

16. The kit of claim 15 wherein the polymeric material includes at least one of the following materials: polyethylene, polypropylene, acrylonitrile butadienestyrene (ABS), vinyl, silicone, and polyester.

17. The kit of claim 1 further comprising at least one of the following: a second adhesive, a nail wipe, a manicuring tool, a placement tool, and nail polish.

18. The kit of claim 1 wherein at least a portion of the application tab assembly comprises a silicone material.

19. The kit of claim 1 wherein at least a portion of the application tab assembly is formed of a material that exhibits sufficient tackiness to temporarily adhere to the upper surface of the artificial nail without the use of an adhesive.

20. The kit of claim 1 wherein at least one of the artificial nails is a nail tip.

21. The kit of claim 1 wherein at least one of the artificial nails is a full nail.

22. A preformed artificial nail assembly for placement on a natural nail, the artificial nail assembly comprising:

(1) an artificial nail body sized to correspond to at least a portion of said natural nail, said nail body including an upper surface and a lower surface, and (2) a one-piece application tab assembly temporarily adhered to the upper surface of said nail body, said application tab assembly comprising:

(a) an attachment portion, wherein at least a portion of said attachment portion comprises a clingy portion having sufficient tackiness to temporarily adhere to said upper surface, and (b) a body portion, wherein at least a portion of said body portion protrudes from said upper surface and is of sufficient size to be grasped by a user to manipulate said application tab assembly and said artificial nail body, and (c) a flange portion.

23. The artificial nail assembly of claim 22 wherein said flange is disposed adjacent an edge of said artificial nail.

24. The artificial nail assembly of claim 22 wherein said flange engages the lower surface of said artificial nail.

25. The artificial nail assembly of claim 22 wherein the application tab assembly comprises a film strip.

26. The artificial nail assembly of claim 22 wherein the body portion of said application tab is disposed at an angle to a plane including the upper surface of said artificial nail.

27. The artificial nail assembly of claim 22 wherein said body portion is disposed in relatively the same plane as the upper surface of said artificial nail.

28. The artificial nail assembly of claim 22 wherein said attachment portion is disposed in relatively the same plane as the upper surface of said artificial nail.

29. The artificial nail assembly of claim 22, wherein the clingy portion further comprises an adhesive disposed between said attachment portion and the upper surface of said artificial nail body, said adhesive being adapted to removably adhere to the upper surface of said nail body.

30. The artificial nail assembly of claim 22, wherein at least a portion of the attachment portion is formed of a material that exhibits sufficient tackiness to temporarily adhere to a surface of the artificial nail without the use of an adhesive.

* * * * *